US009668559B1

(12) United States Patent
Moyal

(10) Patent No.: US 9,668,559 B1
(45) Date of Patent: Jun. 6, 2017

(54) STACKED MULTIPLE COMPARTMENT VACUUM COMPRESSIBLE AND SEALABLE LUGGAGE

(71) Applicant: David Moyal, New York, NY (US)

(72) Inventor: David Moyal, New York, NY (US)

( * ) Notice: Subject to any disclaimer, the term of this patent is extended or adjusted under 35 U.S.C. 154(b) by 530 days.

(21) Appl. No.: 14/134,072

(22) Filed: Dec. 19, 2013

(51) Int. Cl.
*A45C 13/00* (2006.01)
*A45C 13/02* (2006.01)

(52) U.S. Cl.
CPC ..... *A45C 13/008* (2013.01); *A45C 13/02* (2013.01)

(58) Field of Classification Search
CPC .. A45C 3/00; A45C 13/02; A45C 5/00; A45C 3/004; A45C 3/02
USPC ..... 190/100, 109, 111, 103, 18 A; 206/278, 206/503, 524.8, 570; 220/495, 723; 383/100
See application file for complete search history.

(56) References Cited

U.S. PATENT DOCUMENTS 3,800,134 A * 3/1974 Castaldo ..... A45C 15/06 362/155
5,458,164 A 10/1995 Tawil
5,540,500 A 7/1996 Tanaka
5,761,992 A * 6/1998 Gallo ..... A01M 31/00 119/497
5,806,575 A 9/1998 Tsay
5,881,881 A 3/1999 Carrington
6,065,870 A 5/2000 Nunez
6,135,253 A 10/2000 Weissman et al.
6,202,849 B1 * 3/2001 Graham ..... B65D 25/16 206/524.8
6,499,574 B1 * 12/2002 Anthony ..... A45C 13/008 190/102
6,651,520 B1 11/2003 Allen et al.
7,588,160 B2 * 9/2009 Chen ..... B65D 33/01 220/495
8,210,353 B2 7/2012 Epicureo
8,251,192 B1 * 8/2012 Milani ..... A45C 5/03 190/103
8,397,310 B2 * 3/2013 Parris ..... A45C 5/14 340/539.22
8,459,422 B1 6/2013 Efron
2009/0145939 A1 6/2009 Robinson
2011/0259693 A1 10/2011 Nascarella
2013/0048456 A1 * 2/2013 Govor ..... A45C 13/02 190/111

* cited by examiner

*Primary Examiner* — Anthony Stashick
*Assistant Examiner* — Cynthia Collado
(74) *Attorney, Agent, or Firm* — Michael J. Feigin, Esq.; Feigin & Fridman

(57) ABSTRACT

Embodiments of the disclosed technology are directed to an article of luggage having at least one air-sealable compartment/bag disposed therein, and a method of using the article of luggage. A vacuum or pump is used to suction air out of each compartment in order to effectively reduce the size of the compartment. In an embodiment, multiple compartments may be individually compressed. One or more hoses may coupled the compartments to the vacuum. The vacuum may be controlled and operated using switches. Air pressure sensors and/or switches may be used to detect when a compartment is sufficiently compressed. Multiple compartments may be individually compressed in succession via an airflow diversion switch associated with the vacuum.

11 Claims, 6 Drawing Sheets

STACKED MULTIPLE COMPARTMENT VACUUM COMPRESSIBLE AND SEALABLE LUGGAGE

FIELD OF THE DISCLOSED TECHNOLOGY

The disclosed technology relates generally to luggage and, more specifically, to an airtight luggage interior that is sealable and compressible by removing air therefrom.

BACKGROUND OF THE DISCLOSED TECHNOLOGY

People often dread packing for trips. Trying to find space for everything and having an over-stuffed suitcase just isn't many people's idea of a good time. Virtually every traveler has encountered the inevitable battle of zipping closed an overstuffed suitcase. This is a particularly common dilemma for those traveling to colder climates, such as ski destinations, wherein the packed articles of clothing tend to be bulky, such as sweaters, jackets, ski suits, and the like.

Articles of travel for the most part comprise clothing which retains a lot of dead airspace between fibers. As such, articles of clothing take up an inordinate amount of space in a suitcase. To effectively store articles of travel, the user generally must depress the articles of travel manually or apply a force by hand to said articles of travel in order to minimize their volume. The elastic forces of the fibers of clothing does not allow the clothing to retain a minimum storage configuration without some additional manual force applied to compress them into the storage chambers of the apparatus. This can sometimes lead to loss of neatness, winkling and rumpling of clothing, a situation every traveler must contend with. To solve this problem, some ideas have been developed by others that rely on separately storing clothing in pre-made vacuum bags that can compress the clothing when a vacuum is applied to them. These bags are separate from the suitcase and have no formal shape or design intent other than storing individual clothing item in a pre-compressed state for later storage in a suitcase. Thus several such bags are need to store articles of travel effectively. Further, the separate storage bag systems are designed to be rolled into a cylinder by hand, with the stored articles of clothing in them, so that so that all air is removed from the stored articles of clothing.

All of the above causes wrinkling, rumpling and undesired results when suits and other sensitive clothes that must be stored wrinkle-free are stored using such systems. Further they do not form a simple single integrated system for storing articles of clothing, and are generally bought separately from the suitcases. Further, when such existing systems are used to store clothing in a suitcase, they can move about in the suitcase and offer no anchoring system for the clothing stored in them, so that their efficiency in keeping clothes wrinkle free during storage diminishes considerably. The present invention allows the user to have all the advantages of effective and efficient storage of clothing and other articles of travel, without the disadvantages outlined above. Further, the present invention is a simple and unified method of storing articles of travel in a suitcase without the disadvantages and inconvenience of using separate bags and containers for the same. Further, the apparatus of the present invention allows all the articles of clothing stored inside a suitcase to be kept together and neatly in the confines of the suitcase with little or no wrinkling.

Still further, airlines have begun to take restrictive measures to reduce costs. One such restriction has been the reduction of weight and size of carry on and checked baggage. Carry-on bag dimension maximum size requirements are strictly enforced, and often result in passengers having to pay additional fees to check their baggage or carry-on oversized baggage. Moreover, many airlines charge extra fees for checked bags in excess of one.

Thus, air passengers oftentimes find themselves trying to fit as many items as possible into a single piece of luggage. Oftentimes, a suitcase may be so overfilled that the passenger is either unable to close it or damages it in closing it. Thus, there exists a need in the art to maximize the available space inside a piece of luggage.

In the past, others have developed collapsible storage containers which typically include a flexible, air tight bag, and a fixture through which to evacuate excess air. When the air tight bag has been filled with one or more articles, air is evacuated through the fixture, causing the bag to collapse, thereby compressing the articles therein so that the storage container is easier to transport and store in a smaller space.

Examples of same include U.S. Pat. No. 8,459,422 to Efron which discloses luggage with integrated vacuum bags. The vacuum bags are vacuumed via a vacuum integrated on a side of the luggage which engages with a valve located on an exterior surface of the luggage. This reference discloses a piece of luggage with a vacuum-sealable compartment and on-board vacuum. Likewise, U.S. Pat. No. 8,251,192 to Milani discloses a suitcase having a vacuum system which draws air out of clothing and areas adjacent to clothing being stored in a suitcase. The vacuum is disposed within the suitcase and may be plugged into a power outlet. Further, U.S. Pat. No. 6,499,574 to Anthony discloses vacuum-packed luggage and method of manufacture. The reference discloses a vacuum packed suitcase with sealable compartments for vacuum sealing of articles. The suitcase includes a top cover and a more rigidly constructed bottom receptacle, the bottom receptacle having one or more separate article compartments separated by vertical or horizontal walls for organizing the articles of travel, the top cover and bottom receptacle being airtight when sealed over each other so that after packing the air in the compartments can be removed separately or collectively.

There is still room for improvement in the art. In this case, convenience of use, reducing bulk, more effectively packing goods in an article of luggage are needed.

SUMMARY OF THE DISCLOSED TECHNOLOGY

Therefore, it is an object of the disclosed technology to provide a device and method for maximizing the contents that are packable into an article of luggage.

In an embodiment of the disclosed technology, an article of luggage generally has a top side and bottom side partially permanently affixed to each other at a permanently affixed side, at least, at a back side, and partially removably connectable to each other, at least at a front side. Within the luggage, a plurality of air tight storage bags permanently attached to an interior of said article of luggage proximate to said permanently attached side, each having a one-way inlet valve. The luggage also employs a vacuum housed within said article of luggage, and a hose having at least two ends. A first end of the hose is attached to an inlet of the vacuum. A second end of the hose is connectably attachable to each of the one-way inlet valves. In an alternative embodiment, the first end of the hose is permanently attached to the one-way inlet valve. Further, each one-way inlet valve may be coupled to a hose.

The luggage may also have a switch for controlling which bag is decompressed. The vacuum may be configured to decompress each bag one after another. In this embodiment, the vacuum proceeds to an uncompressed bag based on air pressure detection of a compressed bag. Furthermore, the bags may be equal in size and stackable within said article of luggage.

In another embodiment of the disclosed technology, a method employs using a luggage with a plurality of air sealable bags with an integrated vacuum. The method is carried out, not necessarily in the following order, by: a) placing contents in at least two of the air sealable bags, each bag further comprising a first elongated and sealable opening, a valve, and an elongated edge attached to an interior of the luggage; b) closing the sealable opening; c) drawing air from at least one of the plurality of air sealable bags using the vacuum such that the air sealable bag is compressed; d) determining that a first the air sealable bag is compressed by detecting a low air pressure threshold; e) switching a suction flow of the vacuum to a second the air sealable bag; f) drawing air from the second air sealable bag; and/or g) coupling a hose between a one-way valve of a first the air sealable bag and a vacuum, the vacuum residing with the enclosable shell.

In a further embodiment, additional steps may be provided of: toggling a first switch to draw air from a first the air sealable bag; and toggling a second switch to draw air from a second the air sealable bag.

In still another embodiment of the disclosed technology, a luggage has a generally rectangular enclosure having a top shell hinged along one edge to a bottom shell, the top shell releasably fastenable to the bottom shell. Within the luggage are a plurality of generally rectangular air-sealable compartments, each compartment affixed along one edge to an interior portion of the enclosure. A vacuum is fixed to an interior portion of the enclosure. A plurality of hoses extends from the vacuum, each hose in fluid communication with a single compartment of the plurality of compartments. The luggage has a plurality of switches for controlling suction flow from the vacuum, each switch associated with an individual hose of the plurality of hoses.

In further embodiments, the luggage employs a battery for powering the vacuum. Alternatively, an external electrical plug may be used for powering the device. In embodiments, compression is performed on each the compartment in succession. That is, after a first compartment is compressed, then and only then does the vacuum proceed to compressing the second compartment, and so forth. Further, the compartments may be equally sized. Alternatively, the sizes may be tapered such that the bottom-most compartment is the largest and the sizes decrease from the bottom to the top of the article of luggage. The compartments may also be stackable or integrated with one another.

It should be understood that the use of "and/or" is defined inclusively, such that the term "a and/or b" should be read to include the sets: "a and b," "a or b," "a," "b." Further details are set forth in the detailed description below.

DETAILED DESCRIPTION OF EMBODIMENTS OF THE DISCLOSED TECHNOLOGY

In an embodiment of the disclosed technology, an article of luggage has a plurality of air-sealable compartments or bags disposed therein. A vacuum or pump is used to suction air out of each compartment in order to effectively reduce the size of the compartment. In an embodiment, multiple compartments may be individually compressed. Still further, a small vacuum or pump may be equipped on the suitcase such that an external vacuum or pump isn't necessary. The plurality of bags or compartments are arranged in parallel to each other such that each is attached at the same interior side of an article of luggage or the equivalent thereof. In this manner, the bags can be flipped like pages of a book.

Embodiments of the disclosed technology will become clearer in view of the following description of the drawings.

Figure 1:
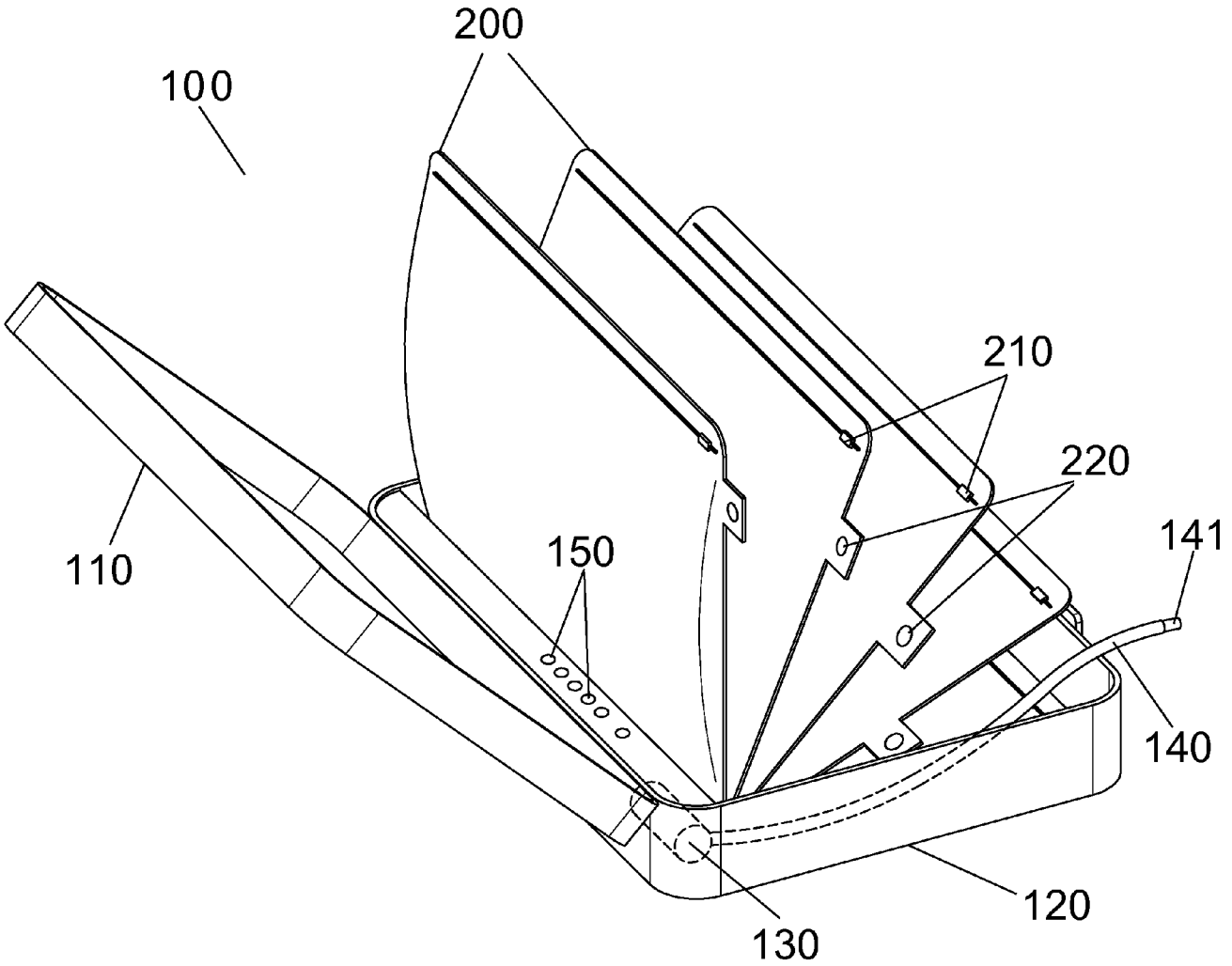
FIG. 1 shows a perspective view of a suitcase with vacuum sealable storage bags according to an embodiment of the disclosed technology.
Figure 2:
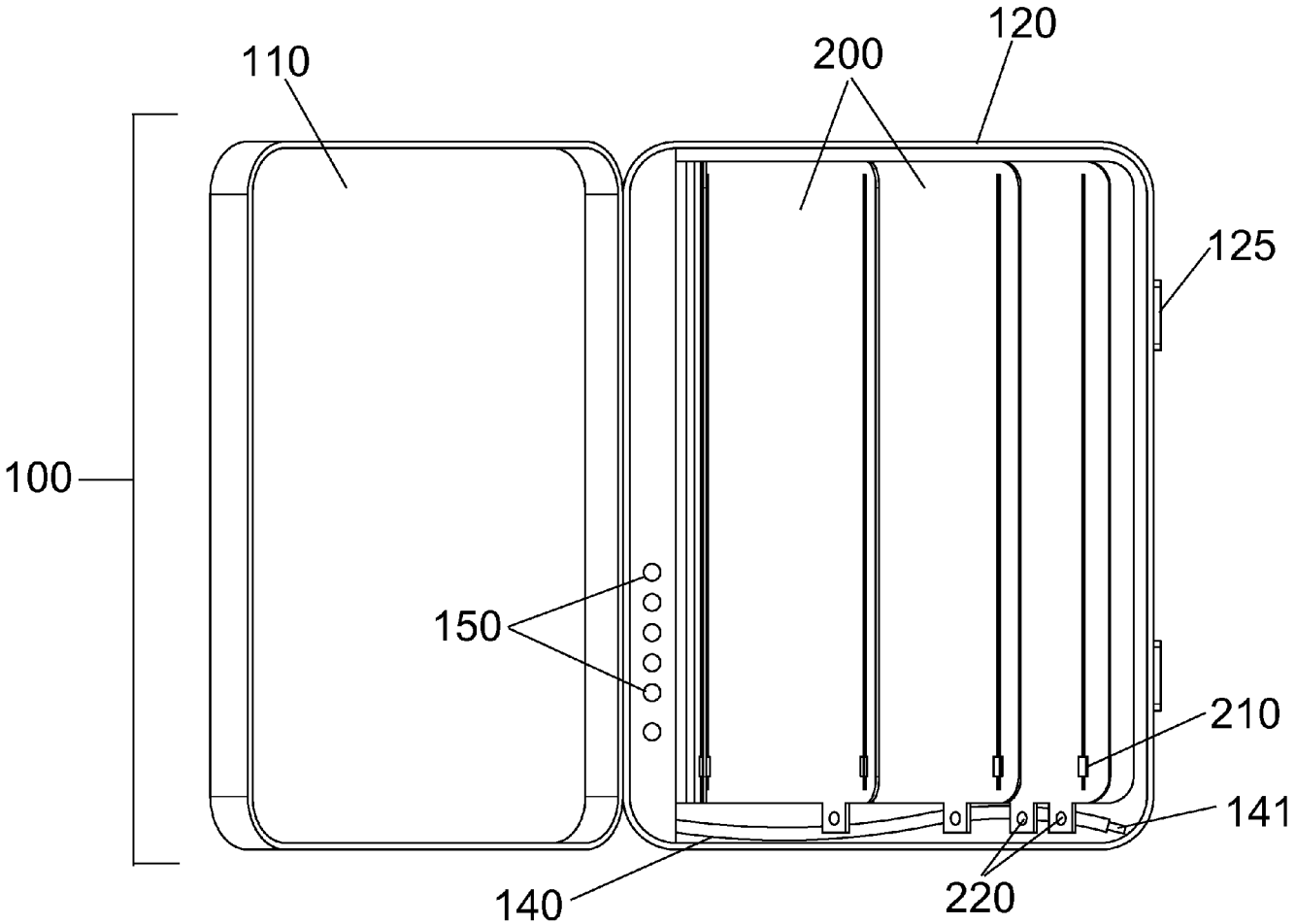
FIG. 2 shows a top plan view of a suitcase with vacuum sealable storage bags according to an embodiment of the disclosed technology.

FIGS. 1 and 2 show a perspective view and a top plan view, respectively, of a suitcase with vacuum sealable storage bags according to an embodiment of the disclosed technology. An article of luggage 100 (hereinafter "luggage 100") has a top side 110 and bottom side 120 partially permanently affixed to each other, at least, at one side, such as a back side. The top side 110 and bottom side 120 are partially removably connectable to each other, at least, at a front side. The front side has a fastening mechanism 125 for removably connecting the top side 110 to the bottom side 120. The luggage 100 has a clam-shell like configuration in that it is openable and closable via a hinge. The luggage 100 depicted in FIGS. 1 through 5 is a generally rectangular suitcase, however any bag, case, trunk or other container may be employed, and the luggage shown is exemplary only. For purposes of this disclosure, mathematical terms such as "parallel" and the term "generally" are defined as "within a 5% tolerance level or that allowed by the industry."

The luggage 100 is shown in its opened state. The interior of the luggage has a number of compartments or bags 200 (herein "compartments 200"). Each compartment 200 may be composed of a flexible or semi-rigid air-tight material. Further, each compartment 200 may he affixed to an interior portion of the luggage 100 and/or the bottom part 120. In the embodiment depicted in FIG. 1, the compartments 200 are rectangular and are affixed along a single edge to an interior of the bottom part 120 near the back side of the luggage 100. Thus, in the embodiment shown, the compartments 200 are configured in an arrangement similar to the pages of a book.

Each compartment 200 has an air-tight zipper 210 for inserting and removing contents from the compartment. Each compartment 200 may further have a valve 220 disposed thereon. The valve 220 may be a one-way valve such that air may pass through the valve and out of the compartment 200, but air may not enter the compartment via the valve. The valves 200 may be disposed on a tongue portion of the compartment 200 for ease of access thereto. As shown, the valves 220 are located such that each is a different distance off of the spine/side of the bag which is affixed to the luggage 100. Thus, each is accessible when the bags 200 lie on top of one another.

Also residing within the luggage 100 is a vacuum or pump 130 (herein "vacuum 130") which draws air out of each of the compartments 200 for purposes of compressing the compartments and/or the contents placed therein. At least one hose 140 extends from the vacuum 130. The hose 140 has a first end 141 and a second end 142, the second end 142 being coupled to the vacuum 130. The first end 141 of the hose 140 has a nozzle or other fitting adapted to mate with the valves 220 for purposes of suctioning air through the valves.

Figure 3:
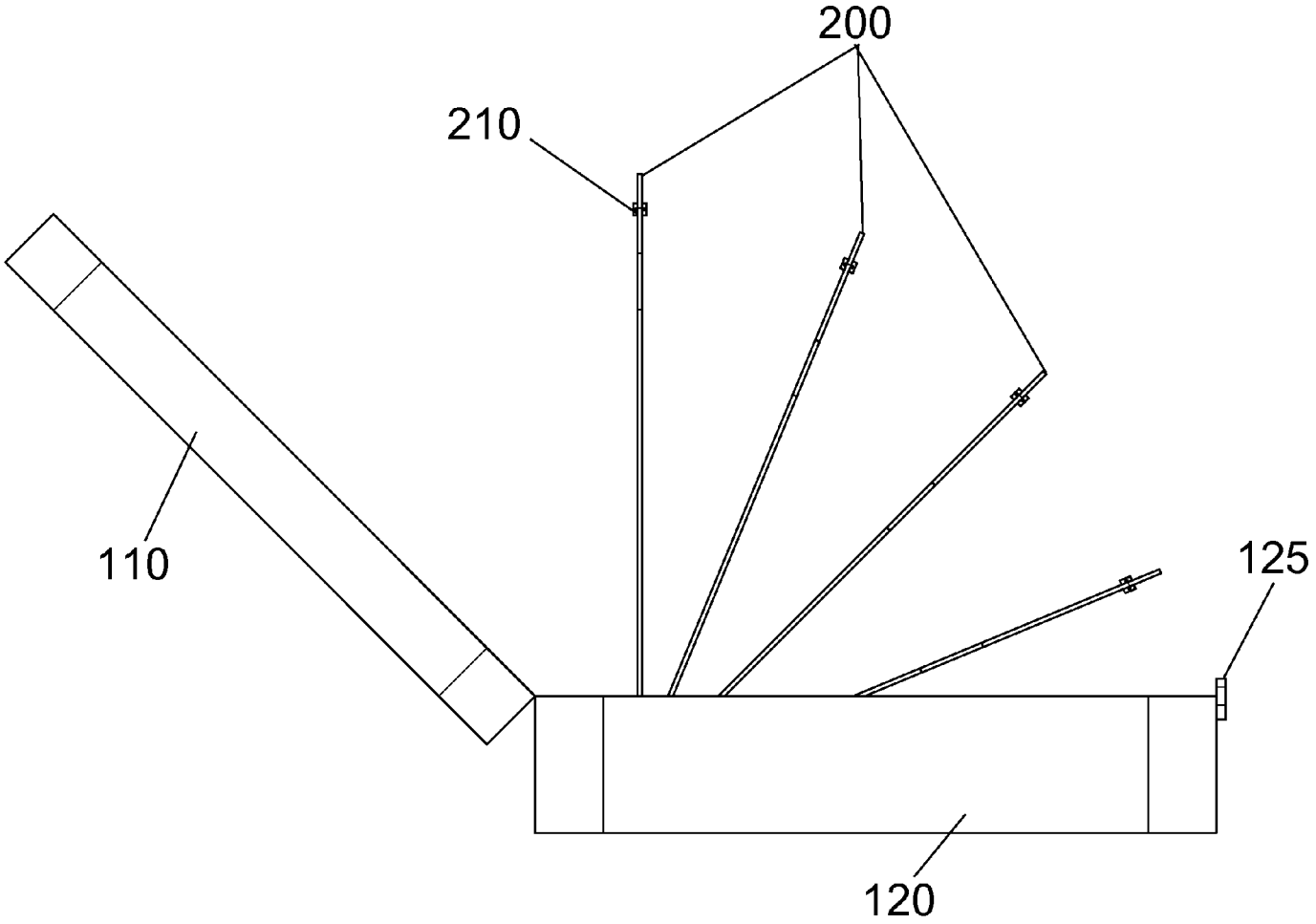
FIG. 3 shows a side elevation view of a suitcase with vacuum sealable storage bags according to an embodiment of the disclosed technology.

FIG. 3 shows a side elevation view of a suitcase with vacuum sealable storage bags according to an embodiment of the disclosed technology. The luggage 100 has a fastening mechanism 125 along a front side thereof. Each compartment 200 is pivotable along an edge. The compartments 200, in their unfilled state, are generally flat and thus do not take up a lot of space. The compartments 200 may be detachable from the interior of the luggage 100 by way of a zipper, hook & loop fastener, or other fastening mechanism. The compartments 200 may be stackable such that they are configured to fit one on top of another within the luggage 100, while the tabs or areas where the valves 220 are, lie at a separate distance from the spine of the luggage (where the bags are each attached).

Figure 4:
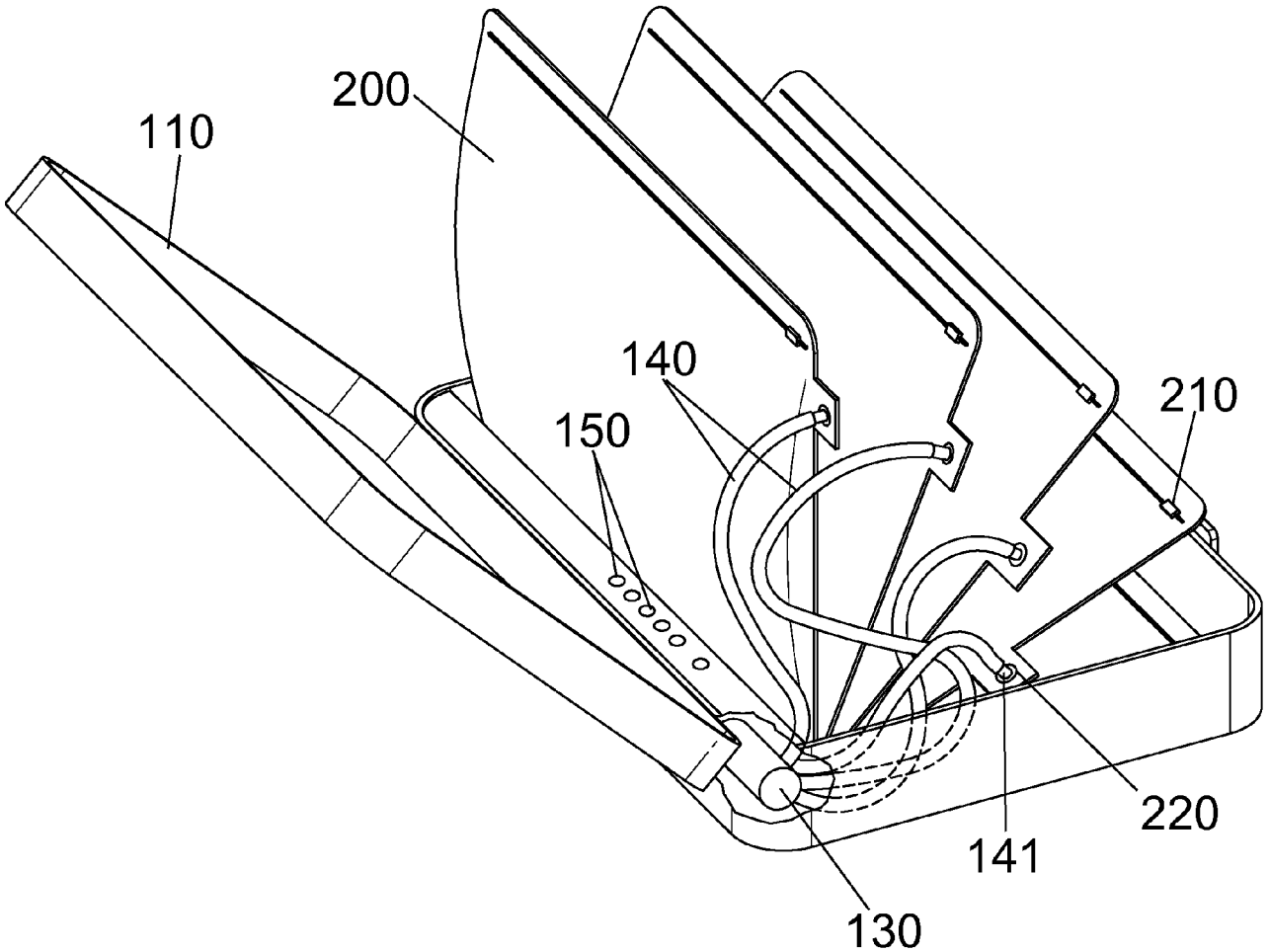
FIG. 4 shows a perspective view of a suitcase with vacuum sealable storage bags and multiple hoses according to an embodiment of the disclosed technology.

FIG. 4 shows a perspective view of a suitcase with vacuum sealable storage bags and multiple hoses according to an embodiment of the disclosed technology. This embodiment shows multiple hoses 140 extending from the vacuum 130. Each hose 140 serves a different compartments. In the example shown, there are four compartments 200 with four hoses 140, one hose running each compartment. The hoses 140 are connected to the compartments via the valves 220 disposed on each compartment. In further embodiments, the hoses 140 may be permanently coupled to the compartments 200. Still further, the vacuum 130 may be in fluid communication with the compartments directly or via any other type of airtight connection.

One or more switches or buttons (herein "switches 150") are disposed on a portion of the luggage 100. The switches 150 may toggle operation of the vacuum. The switches 150 may turn the vacuum 130 on/off and may control the airflow through the hose or hoses 140. Thus, in an embodiment, a first switch may direct air from a first compartment through a first hose. A second switch may direct air from a second compartment through a second hose, and so forth. In another embodiment, the control of airflow may be automated such that the vacuum 130 may compress each compartment 200 individually, in succession. Thus, when a first compartment is fully compressed, suction may be diverted to a second compartment and so forth. In another embodiment, the switches 150 may be disposed on an exterior of the luggage 150

An air pressure switch or sensor (not shown) may be in line with each hose/compartment. The switch is operable to cease suctioning through the particular hose when the pressure drops below a certain threshold. The threshold indicates to the vacuum that the compartment has reached a substantially compressed state. Alternatively, the air pressure sensor may be configured to indicate to a user that a threshold pressure has been achieved and compression may be ceased.

Figure 5:
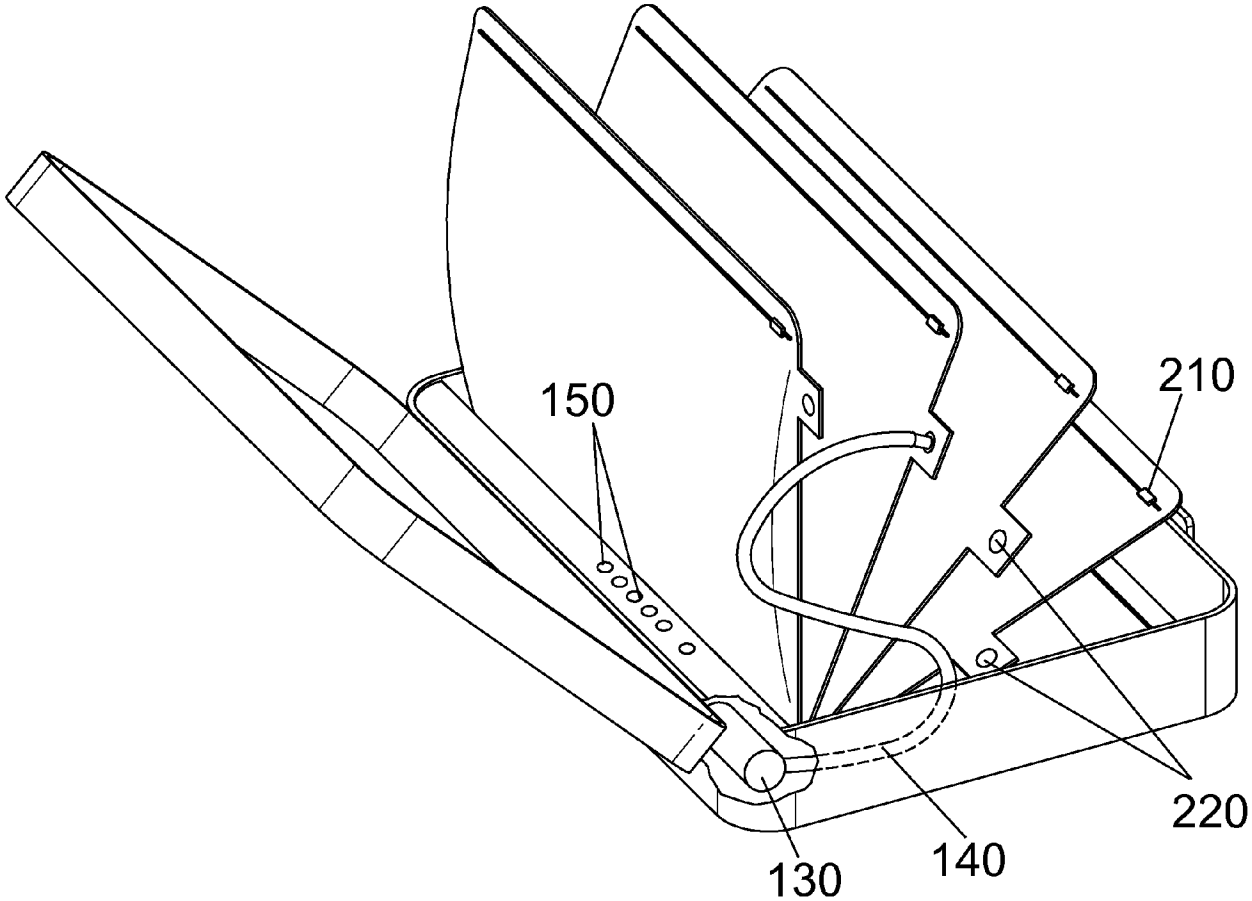
FIG. 5 shows a perspective view of a suitcase with vacuum sealable storage bags and a single hose according to an embodiment of the disclosed technology.

FIG. 5 shows a perspective view of a suitcase with vacuum sealable storage bags and a single hose according to an embodiment of the disclosed technology. In this embodiment, a user may manually connect the hose 140 to each valve 220 for compression. In this embodiment, the vacuum 130 is controlled by the user.

The vacuum 130 may be powered by a battery or an external power plug. The battery may be rechargable such that on a single charge, the vacuum may be used multiple times. The battery may be a lithium ion battery and may be stored in the luggage 100 along with the vacuum 130. In another embodiment, instead of or in addition to a vacuum 130, a manual, vacuum pump may be disposed within said luggage 100. Such a hand-pump works in similar fashion to a bicycle pump, except that it is used to draw air out of a closed area as opposed to pumping air into it. The hand-pump has a cylinder with a piston, and a valve/hose. The piston is drawn out of the cylinder using a handle, which causes air to be pulled into the cylinder via the valve.

Figure 6:
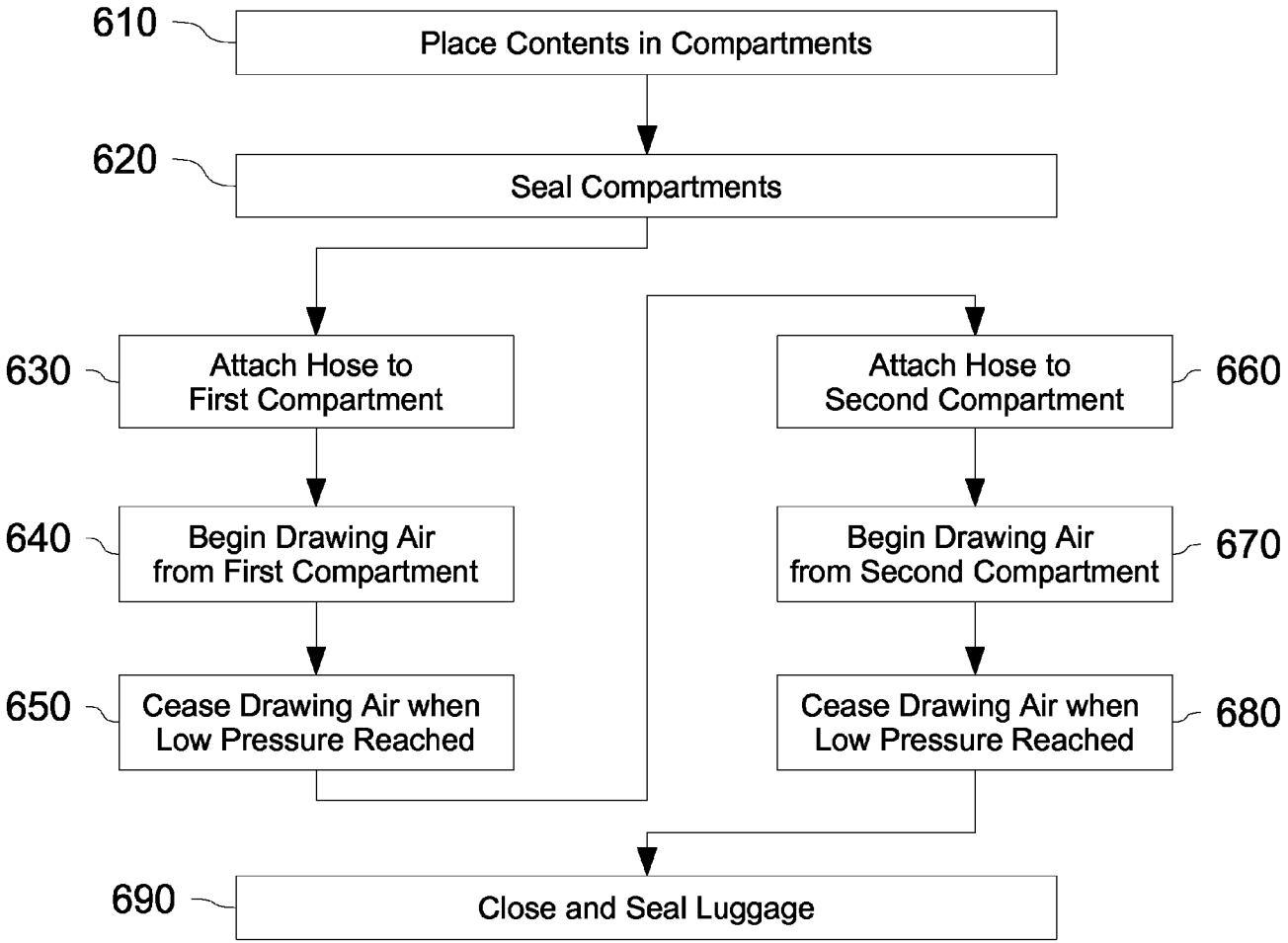
FIG. 6 shows a flow chart outlining the steps of a method of carrying out embodiments of the disclosed technology.

FIG. 6 shows a flow chart outlining the steps of a method of carrying out embodiments of the disclosed technology. The steps shown are merely one configuration of many possible configurations for packing and sealing contents within an article of luggage as described with respect to FIGS. 1 through 5. The method begins in step 610 whereby contents are placed in the compartments/bags. The contents may be any items that may be packed in luggage. Items such as clothing and other items formed of flexible material are best suited for use because such items may be compressed to occupy a limited amount of space. Once the contents are placed therein, the compartments are sealed in step 620. In step 630, the hose is attached to a valve of the first compartment. Preferably, the lowermost compartment is compressed first. Thus, referring back to FIG. 3, the compartment closest bottom part 120 would be compressed first.

Next, in step 640, air begins to be drawn out of the first compartment. As the air is drawn out of the compartment, the pressure within the vacuum, hose, and compartment begins to drop. The drop in pressure is a good indicator of the state of compression of the compartment. Thus, an air pressure switch, sensor or gauge may be employed in step 650 whereby the drawing of air is ceased. A switch may automatically cease the suction of air when the pressure drops below a specified threshold. Alternatively, a sensor or gauge may indicate to a user that a low pressure threshold has been met, thus signifying that suction should be ceased.

After compression of the first compartment is completed, the hose may be removed from the first compartment and attached to a valve of the second compartment in step 660. In step 670, the drawing of air from the second compartment is initiated. Again, the second compartment is compressed until the pressure threshold is met. After which, in step 680, the suctioning is ceased. If the luggage contains more than two compartments, those compartments would be subsequently compressed as well in similar manner to the steps 630 through 650 for the first compartment, and steps 660 through 680 for the second compartment.

After all of the compartments are compressed, the luggage may be closed and sealed. Before closing, the vacuum and/or hose may be stowed or stored within the luggage. Upon closing, the fastener may releasably affix the top part to the bottom part of the luggage. In a further embodiment, the entire outer casing of the luggage (e.g. the top and bottom) may be air tight and compressible as well. Obviously, given the size of the luggage and the fastener, it would be difficult to make the luggage entirely air tight. However, air may be removed from the luggage, if only temporarily, for purposes of fitting in a tight space, such as an overhead compartment on an commercial airplane. The air removal may be carried out by the integrated air vacuum or hand pump, or by an external air suction means.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

I claim:

1. An article of luggage, comprising:

a top side and bottom side permanently affixed to each other at, at least part of a back side and partially removably connectable to each other, at least at a front side;

a plurality of air tight storage bags permanently attached to an interior of said article of luggage proximate to said permanently affixed side, each having a one-way inlet valve;

a vacuum housed within said article of luggage; and a hose having at least two ends, a first end attached to an inlet of said vacuum;

wherein said bags are equal in size and stacked within said article of luggage;

wherein said one-way inlet valve of each said bag are non-overlapping in said stacked condition;

wherein toggling a first switch draws air from a first said air sealable bag; and toggling a second switch to draws air from a second said air sealable bag.

2. The article of luggage of claim 1, wherein said first end of said hose is permanently attached to said one-way inlet valve.

3. The article of luggage of claim 2, further comprising a switch for controlling which said hose is operated to decompress a corresponding said bag.

4. The article of luggage of claim 1, wherein said one-way inlet valve of each said bag is at a different distance from said permanently affixed side of said luggage than every other said bag.

5. The article of luggage of claim 1, wherein each one-way inlet valve is coupled to a hose attached to said vacuum.

6. An article of luggage, comprising:

a generally rectangular enclosure having a top shell hinged along one edge to a bottom shell, said top shell releasably fastenable to said bottom shell;

a plurality of generally rectangular air-sealable compartments, each compartment affixed along one single edge to an interior portion of said enclosure and having a valve at a different position than every other valve of every other said air-sealable compartment;

a vacuum fixed to an interior portion of said enclosure;

a plurality of hoses extending from said vacuum, each hose in fluid communication with a single compartment of said plurality of compartments; and a plurality of switches for controlling suction flow from said vacuum, each switch associated with an individual hose of said plurality of hoses.

7. The article of luggage of claim 6, further comprising a battery for powering said vacuum.

8. The article of luggage of claim 6, further comprising a power plug extending from said enclosure for powering said vacuum.

9. The article of luggage of claim 6, wherein compression is performed on each said compartment in succession.

10. The article of luggage of claim 6, wherein said compartments are equally sized.

11. The article of luggage of claim 6, wherein said compartments are stackable having tapering sizes.

* * * * *